US007559427B2

(12) United States Patent
Hu

(10) Patent No.: US 7,559,427 B2
(45) Date of Patent: Jul. 14, 2009

(54) TOOLBOX APPARATUS

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 293 days.

(21) Appl. No.: 11/553,298

(22) Filed: Oct. 26, 2006

(65) Prior Publication Data

US 2008/0060960 A1 Mar. 13, 2008

(30) Foreign Application Priority Data

Sep. 13, 2006 (TW) ..... 95216339 U

(51) Int. Cl.
*B65D 85/28* (2006.01)

(52) U.S. Cl. ..... 206/764; 206/45.2; 206/45.24; 206/376; 206/1.5

(58) Field of Classification Search ..... 206/373, 206/207, 349, 376, 372, 377, 378, 379, 45.2, 206/45.23, 45.24, 751, 752, 769, 774, 759, 206/764, 1.5; 211/70.6; 220/833, 831, 832; 248/450, 223.41, 128, 158
See application file for complete search history.

(56) References Cited

U.S. PATENT DOCUMENTS 3,913,711 A * 10/1975 Schmid ..... 190/16
4,930,628 A * 6/1990 Bridges ..... 206/45.23
5,267,668 A * 12/1993 Jones ..... 220/326
5,775,499 A * 7/1998 Budert ..... 206/379
5,823,353 A * 10/1998 Perrin et al. ..... 206/752
5,927,487 A * 7/1999 Whittle et al. ..... 206/45.2
6,131,740 A * 10/2000 Huang ..... 206/759
6,267,238 B1 * 7/2001 Miller et al. ..... 206/349
6,591,985 B2 * 7/2003 Lai ..... 206/373
2003/0221984 A1 * 12/2003 Huang ..... 206/372
2004/0035748 A1 * 2/2004 Hernandez et al. ..... 206/748
2004/0188322 A1 * 9/2004 Chen ..... 206/749
2008/0190920 A1 * 8/2008 Farrar et al. ..... 220/4.22

OTHER PUBLICATIONS

Taiwanese Patent No. M260383, Apr. 1, 2005, 6 pages.

* cited by examiner

*Primary Examiner*—Jacob K Ackun, Jr.
*Assistant Examiner*—Robert Poon
(74) *Attorney, Agent, or Firm*—Alan Kamrath; Kamrath & Associates PA

(57) ABSTRACT

A toolbox apparatus includes a case, a cover and a flexible strip for pivotally connecting the case to the cover. The case includes a space defined therein for containing tools, an inclined face formed thereon, at least one engagement unit formed on the inclined face and at least one block formed thereon. The cover includes an inclined face for contact with the inclined face of the case in a displaying position of the toolbox apparatus, at least one engagement unit formed on the inclined face thereof for engagement with the engagement unit of the case for retaining the toolbox apparatus in the displaying position and at least one buckle formed thereon for engagement with the block of the case in a closed position.

16 Claims, 11 Drawing Sheets

TOOLBOX APPARATUS

BACKGROUND OF INVENTION

1. Field of Invention

The present invention relates to a toolbox apparatus and, more particularly, to a toolbox apparatus for easy and stable displaying of tools contained therein.

2. Related Prior Art

Disclosed in Taiwanese Patent M260383 is a conventional toolbox apparatus that includes a case 10 and a cover 20. The case 10 includes cavities 12 made in an internal face, an inclined face 13, a connective portion 11 formed along an edge between the internal face and the inclined face 13 and two tracks 15 each formed on a related one of two lateral faces. The cover 20 includes two connective portions 21 formed on a rear face and two tracks 21 each formed on a related one of two lateral faces. The connective portion 11 of the case 10 is pivotally connected to the connective portions 21 of the cover 20. A buckle 30 is movably mounted on each of the tracks 15 of the case and a related one of the tracks 24 of the cover 20. Tools are disposed in the cavities 12. To display the tools, the cover 20 is pivoted from the case 10 for more than 270 degrees. An internal face of the cover 20 is located on a horizontal surface such as the ground or a desk top so that an external face 22 of the cover 20 is directed upwards. The inclined face 13 of the case 10 is located on the external face 22 of the cover 20. Thus, the tools are displayed. However, while trying to take one of the tools from a related one of the cavities 12, a potential buyer might cause the case 10 to pivot and fall so that some other tools might drop from the related ones of the cavities 12. Furthermore, it is impossible to know what tools are available when the toolbox apparatus is closed, since they are concealed in the closed toolbox apparatus. Moreover, it is difficult to carry the toolbox apparatus without any handle.

The present invention is therefore intended to obviate or at least alleviate the problems encountered in the prior art.

SUMMARY OF INVENTION

According to the present invention, a toolbox apparatus includes a case, a cover and a flexible strip for pivotally connecting the case to the cover. The case includes a space defined therein for containing tools, an inclined face formed thereon, at least one engagement unit formed on the inclined face and at least one block formed thereon. The cover includes an inclined face for contact with the inclined face of the case in a displaying position of the toolbox apparatus, at least one engagement unit formed on the inclined face thereof for engagement with the engagement unit of the case for retaining the toolbox apparatus in the displaying position and at least one buckle formed thereon for engagement with the block of the case in a closed position.

The primary advantage of the toolbox apparatus according to the present invention is stable display of the tools, since it can be retained in the displaying position.

Other advantages and features of the present invention will become apparent from the following description referring to the drawings.

BRIEF DESCRIPTION OF DRAWINGS

The present invention will be described through detailed illustration of four embodiments referring to the drawings.

DETAILED DESCRIPTION OF EMBODIMENTS

Figure 1:
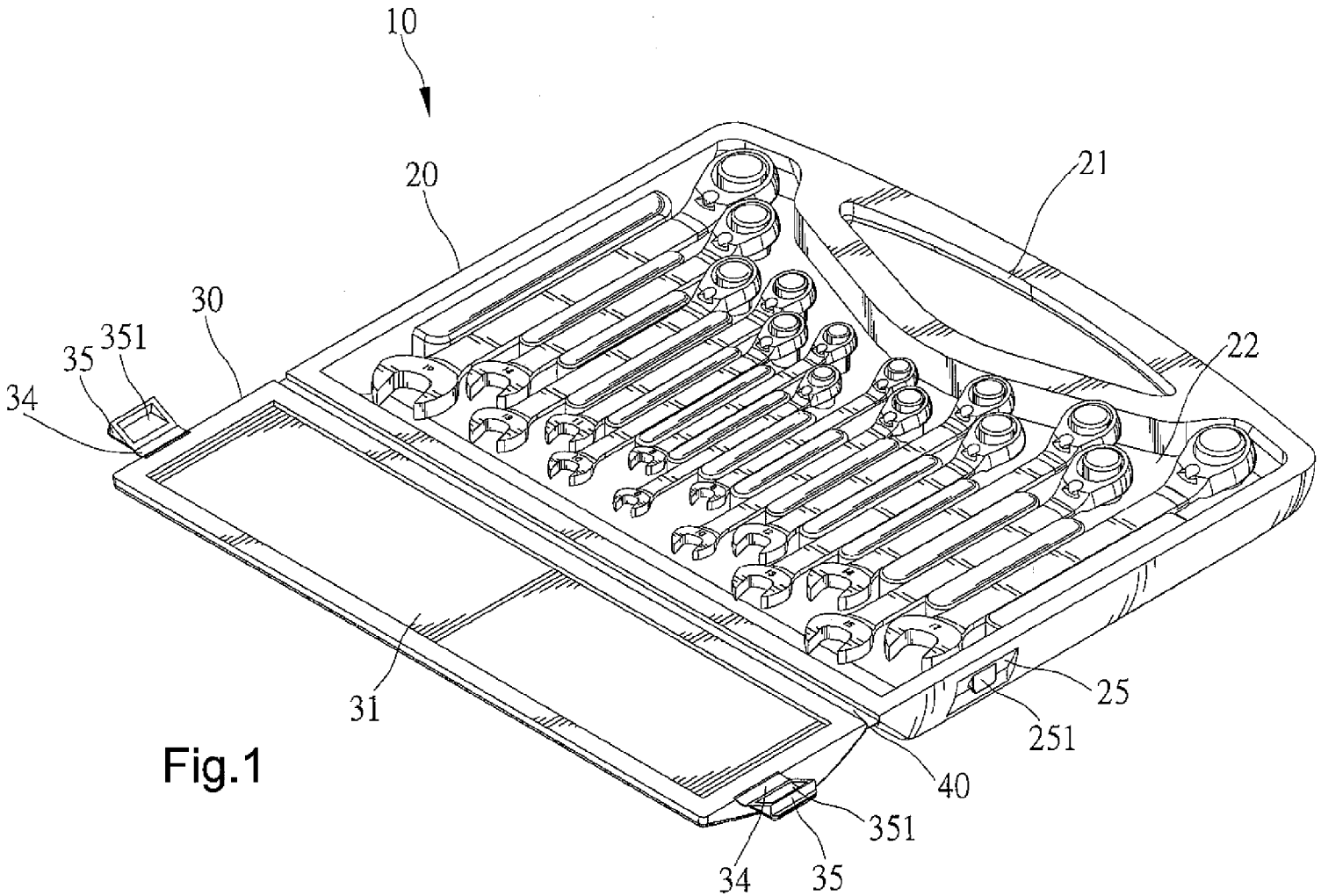
FIG. 1 is a perspective view of a toolbox apparatus according to the first embodiment of the present invention.

Referring to FIGS. 1 through 9, there is shown a toolbox apparatus 10 according to a first embodiment of the present invention. The toolbox apparatus 10 includes a case 20, a cover 30 and a flexible strip 40 for pivotally connecting the case 20 to the cover 30. Preferably, the case 20, the cover 30 and the flexible strip 40 are made as one piece.

In the following description, the term "internal face" is used to describe a face that is concealed when the toolbox apparatus 10 is closed, and the term "external face" is used to describe a face that is exposed when the toolbox apparatus 10 is closed.

Referring to FIG. 1, the case 20 includes a handle 21 formed thereon and located opposite to the flexible strip 40, a space 22 defined in an internal face for containing tools, two recesses 25 each defined in a related one of two lateral faces and two blocks 251 each formed on a related one of the lateral faces within the related recess 25.

The cover 30 includes a space 31 defined in an internal side for containing the tools and two buckles 35 each pivotally connected to a related one of two lateral faces by a flexible strip 34. Each of the buckles 35 defines a recess 351.

Figure 7:
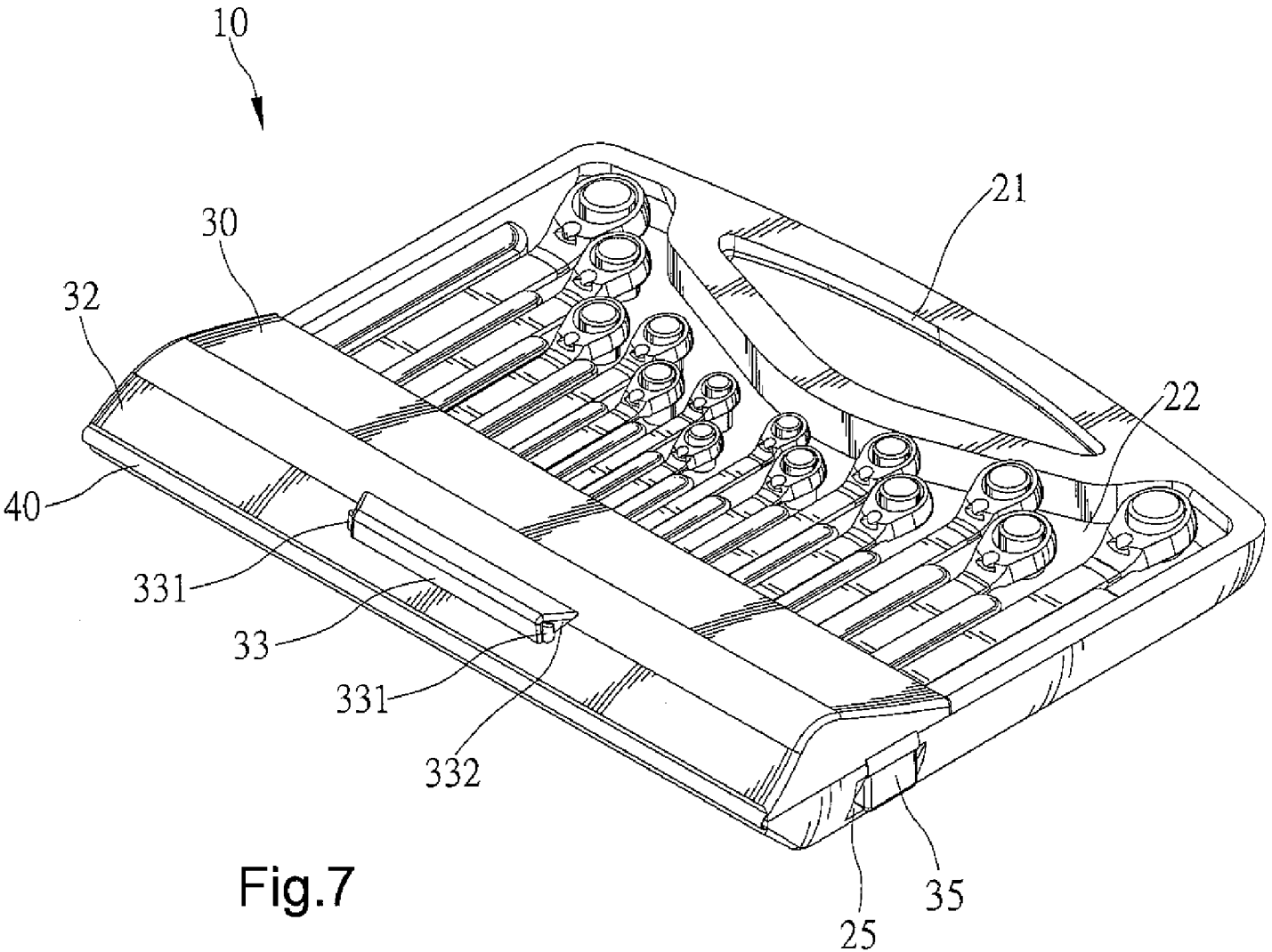
FIG. 7 is a perspective view of the toolbox apparatus in a closed position different from the open position shown in FIG. 1.

Referring to FIG. 7, the toolbox apparatus 10 is closed. The toolbox apparatus 10 is kept in the closed position, because the buckles 35 are engaged with the blocks 251. In specific, the buckles 35 are located within the recesses 25 while the blocks 251 are located within the recesses 351. The tools can be seen and touched by potential buyers, since each of the tools is only partially covered by the cover 30. It is easy for shop keepers to observe the tools and prevent theft of the tools.

Figure 8:
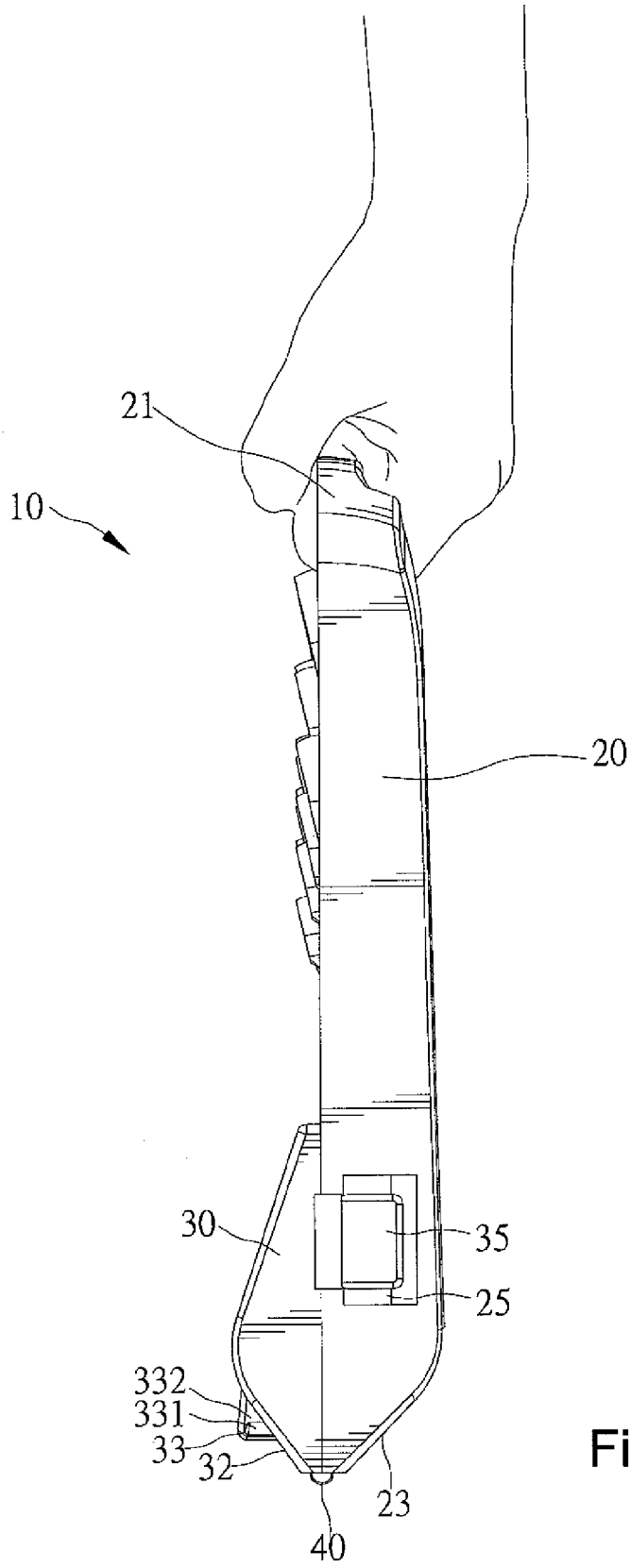
FIG. 8 is a side view of a hand holding the toolbox apparatus shown in FIG. 7.

Referring to FIG. 8, it is easy to carry the toolbox apparatus 10 located in the closed position because of the handle 21.

Figure 2:
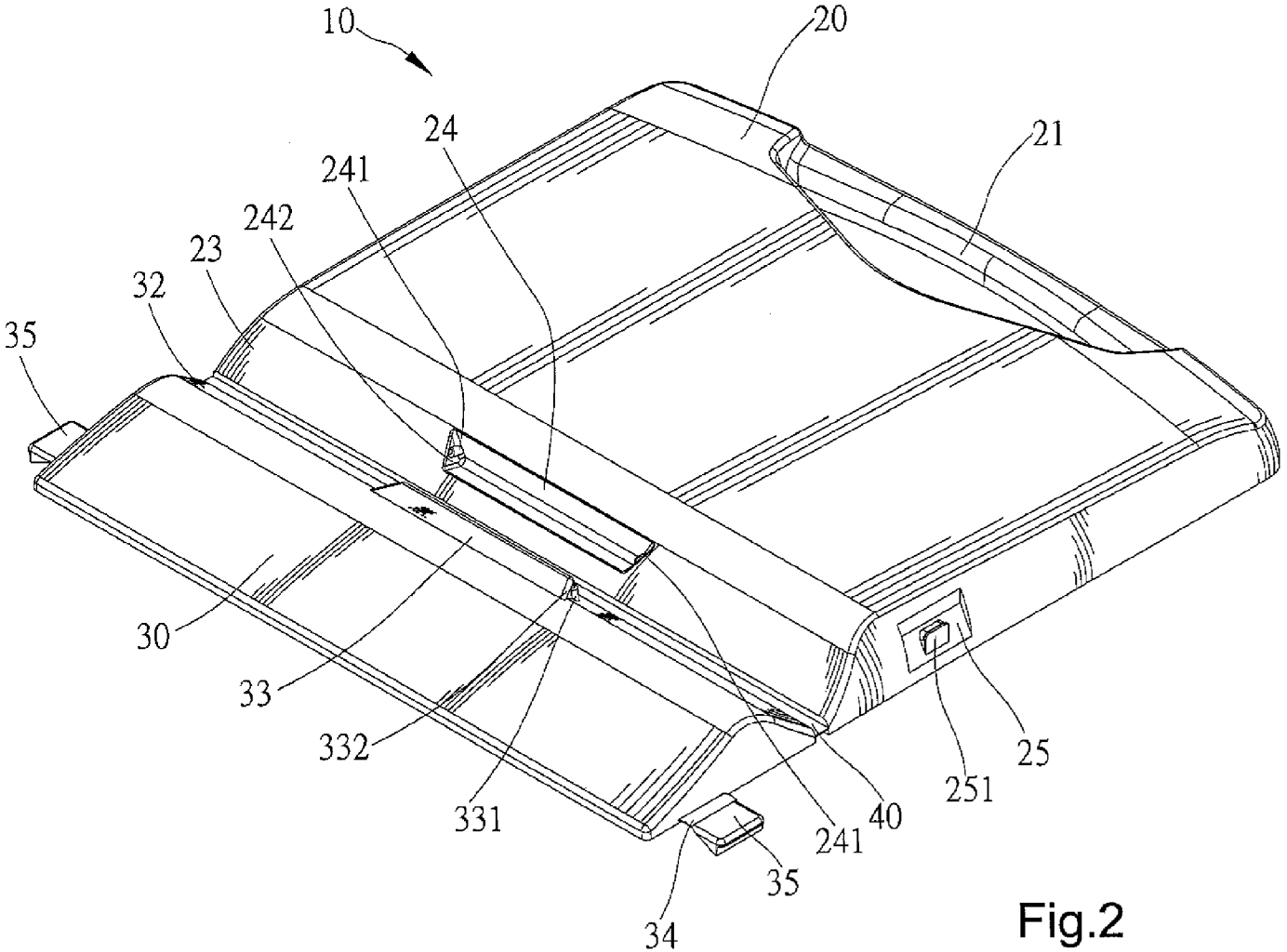
FIG. 2 is another perspective view of the toolbox apparatus shown in FIG. 1.

Referring to FIG. 2, the case 20 includes an inclined face 23 formed thereon near the flexible strip 40 and a groove 24 defined in the inclined face 23. The groove 24 is defined between two walls. A restraint 241 is formed on each of the walls and a recess 242 is defined in each of the walls near the restraint 241. Preferably, the restraints 241 are semi-cylindrical. The groove 24, the restraints 241 and the recesses 242 together form an engagement unit.

The cover 30 includes an inclined face 32 formed thereon near the flexible strip 40 and a ridge 33 formed on the inclined face 32. The ridge 33 includes two ends. A restraint 331 is formed on each of the ends, and a recess 332 is defined in each of the ends near the restraint 331. Preferably, the restraints 331 are semi-cylindrical. The ridge 33, the restraints 331 and the recesses 332 together form an engagement unit.

Figure 3:
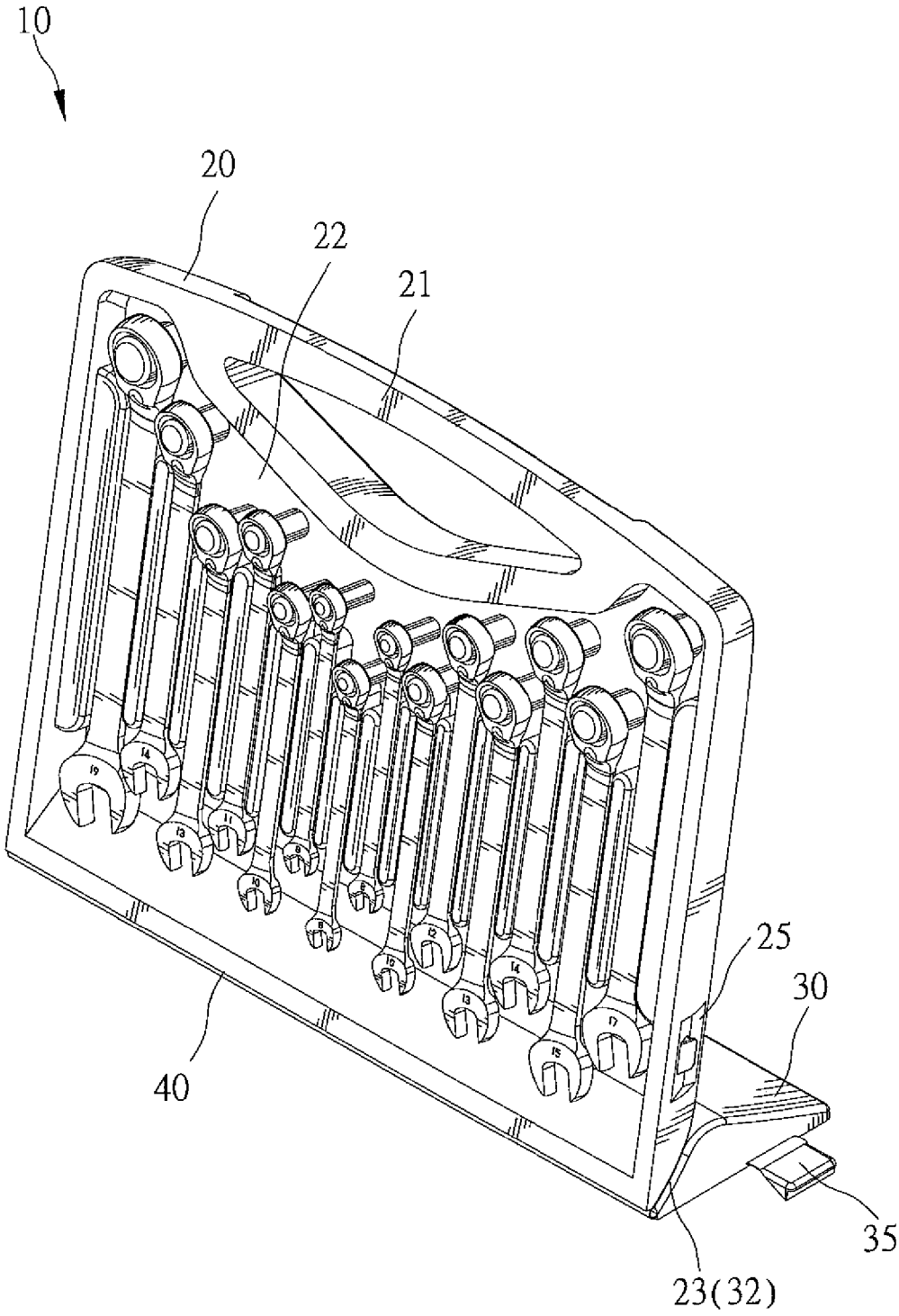
FIG. 3 is a perspective view of the toolbox apparatus shown in FIG. 1 located in a displaying position.

Referring to FIG. 3, the toolbox apparatus 10 is located in a displaying position. The internal face of the cover 30 is located on a horizontal face such as the ground or a desk top. The internal face of the case 20 is directed forwards and upwards. The inclined face 23 of the case 20 is located on the inclined face 32 of the cover 30.

Figure 4:
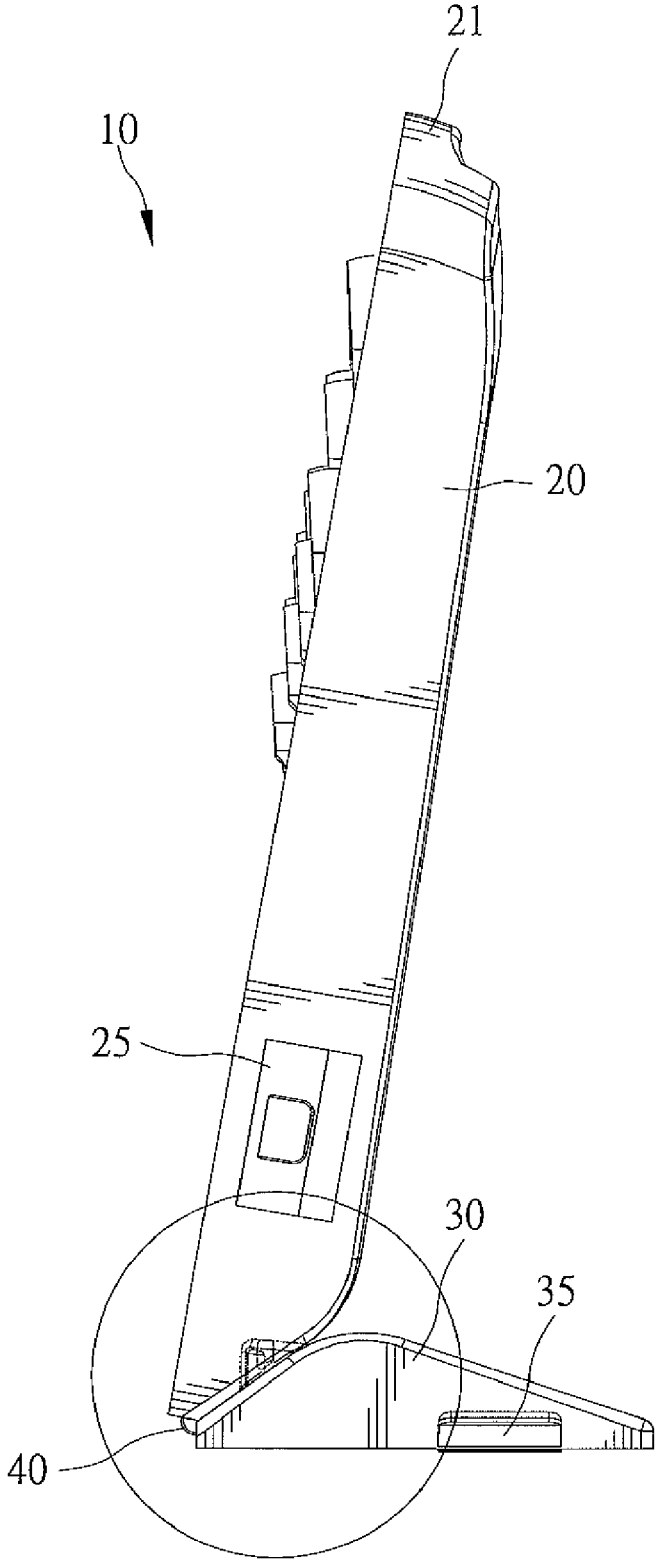
FIG. 4 is a side view of the toolbox apparatus shown in FIG. 3.
Figure 5:
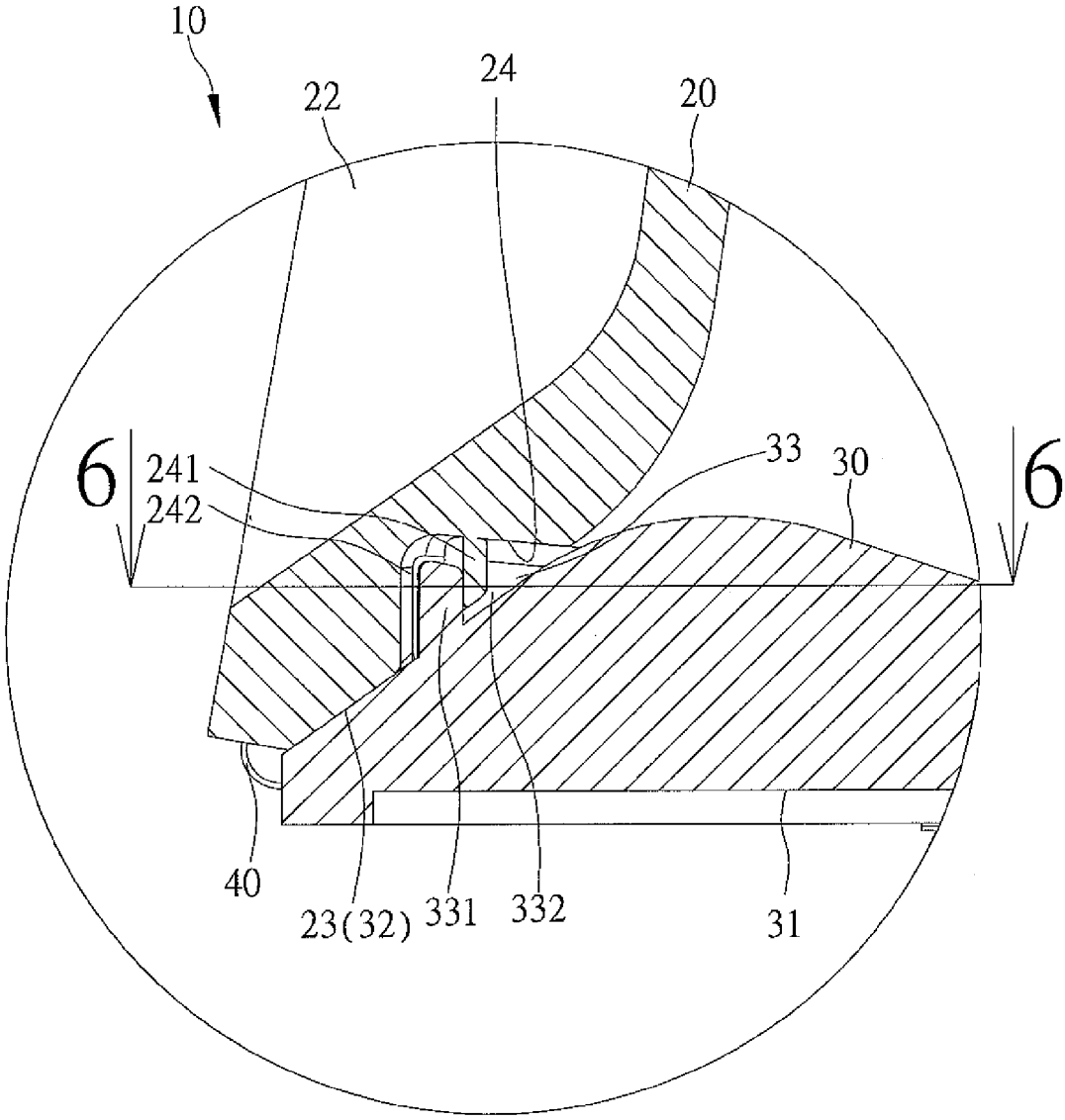
FIG. 5 is an enlarged partial cross-sectional view of the toolbox apparatus shown in FIG. 4.
Figure 6:
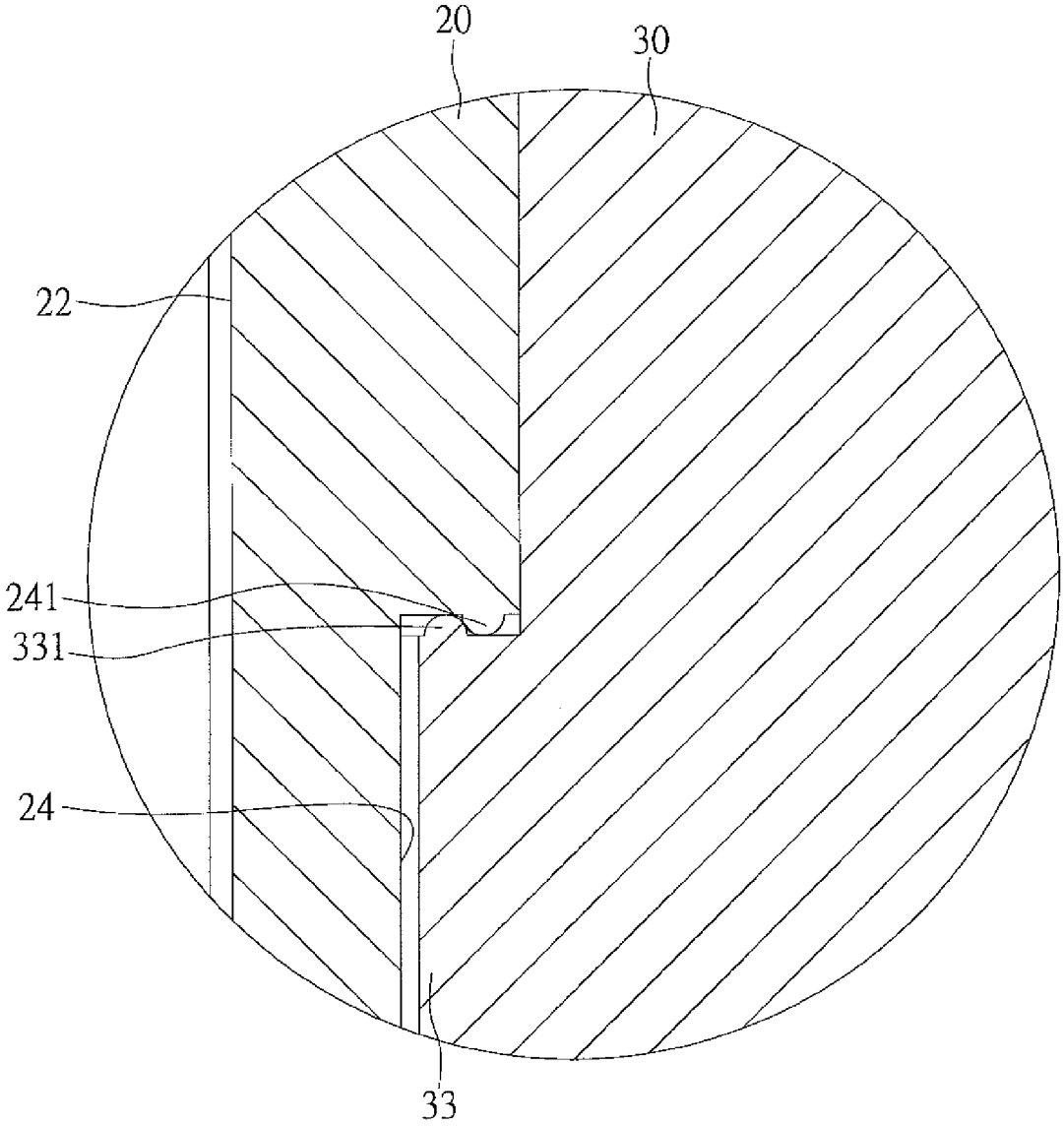
FIG. 6 is a cross-sectional view of the toolbox apparatus taken along a line 6-6 in FIG. 5.

Referring to FIGS. 4 through 6, the ridge 33 is located within the groove 24. The restraints 331 of the cover 30 are engaged with the restraints 241 of the case 20. The restraints 331 of the cover 30 are located within the recesses 242 of the case 20, while the restraints 241 of the case 20 are located within the recesses 332 of the cover 30. Thus, the toolbox apparatus 10 is kept in the displaying position.

Figure 9:
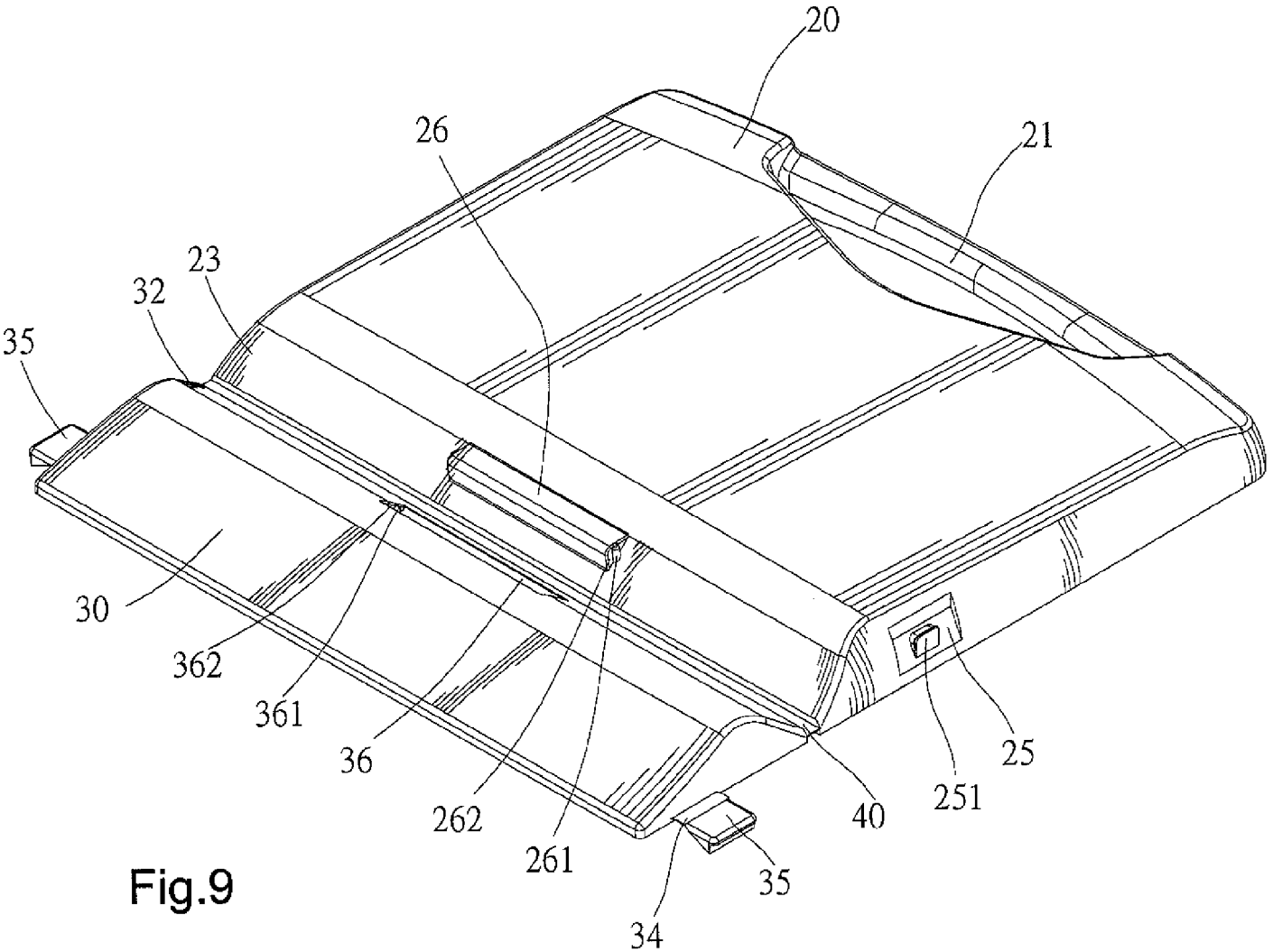
FIG. 9 is a perspective view of a toolbox apparatus according to the second embodiment of the present invention.

Referring to FIG. 9, there is shown a toolbox apparatus according to a second embodiment of the present invention. The second embodiment is like the first embodiment except two features. Firstly, the inclined face 23 of the case 20 includes a ridge 26 instead of the groove 24. The ridge 26 includes two restraints 261 and two recesses 262. The ridge 26, the restraints 261 and the recesses 262 are identical to the ridge 33, the restraints 331 and the recesses 332, respectively. Secondly, the inclined face 32 of the cover 30 includes a groove 36 instead of the ridge 33. A restraint 361 is formed on and a recess 362 is defined in each of two walls between which the groove 36 is defined. The groove 36, the restraints 361 and the recesses 362 are identical to groove 24, the restraints 241 and the recesses 242, respectively.

Figure 10:
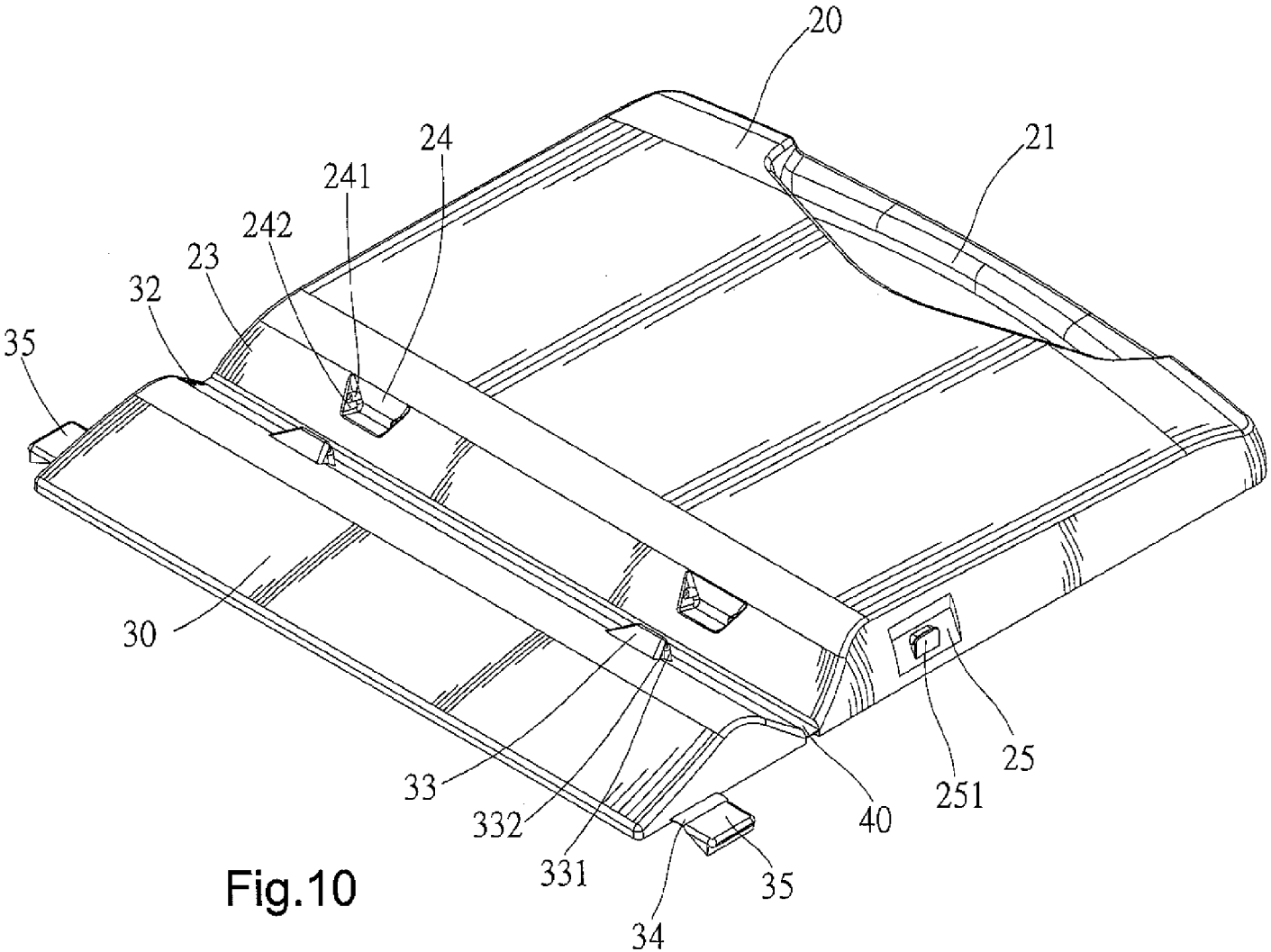
FIG. 10 is a perspective view of a toolbox apparatus according to the third embodiment of the present invention.

Referring to FIG. 10, there is shown a toolbox apparatus according to a third embodiment of the present invention. The third embodiment is identical to the first embodiment except two features. Firstly, there are two grooves 24 defined in the inclined face 23 of the case 20. Secondly, there are two ridges 33 formed on the inclined face 32 of the cover 30.

Figure 11:
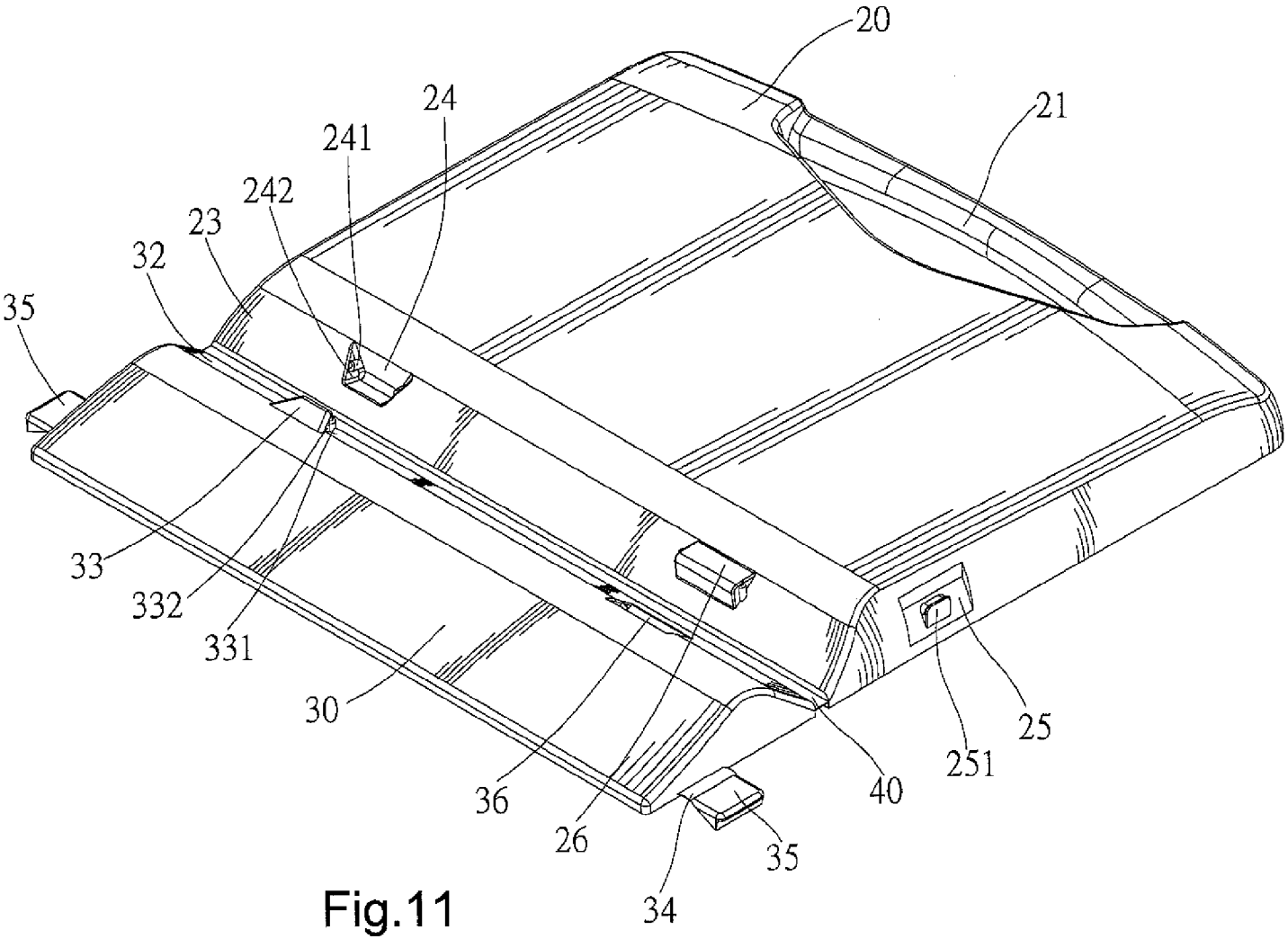
FIG. 11 is a perspective view of a toolbox apparatus according to the fourth embodiment of the present invention.

Referring to FIG. 11, there is shown a toolbox apparatus according to a fourth embodiment of the present invention. The fourth embodiment is identical to the third embodiment except two features. Firstly, there is a groove 24 defined in and a ridge 26 formed on the inclined face 23 of the case 20. Secondly, there is a ridge 33 formed on and a groove 36 defined in the inclined face 32 of the cover 30.

An advantage of the toolbox apparatus according to the present invention is stable display of the tools, since it can be retained in the displaying position.

Another advantage of the toolbox apparatus according to the present invention is continuous display of the tools even in the closed position since the case is only partially covered by the cover.

Still another advantage of the toolbox apparatus according to the present invention is easy transportation because of the handle.

The present invention has been described through the illustration of the embodiments. Those skilled in the art can derive variations from the embodiments without departing from the scope of the present invention. Hence, the embodiments shall not limit the scope of the present invention defined in the claims.

What is claimed is:

1. A toolbox apparatus comprising:

a case comprising a case face, two lateral faces on opposite sides of the case face, and an inclined face extending between the two lateral faces and from the case face, with a space defined by the case face, the two lateral faces and the inclined face for containing tools, with the inclined face formed at an obtuse angle to the case face, with at least one block formed on the case;

a cover comprising a cover face, two lateral faces opposite sides of the cover face, and an inclined face, with the inclined face of the cover extending at an obtuse angle to the cover face, with the cover including at least one buckle for engagement with the at least one block of the case in a closed position;

at least one first engagement unit comprising a groove defined in the inclined face of one of the case and the cover and two restraints formed on two walls of the groove;

at least one second engagement unit comprising a ridge formed on the inclined face of another of the case and the cover and two restraints formed on the ridge for engagement with the two restraints formed on the two walls of the groove when the ridge is located within the groove; and a flexible strip extending between the case and the cover and pivotally connecting the case to the cover between the closed position and a displaying position, with the inclined faces of the case and the cover being in contact in the displaying in position.

2. The toolbox apparatus according to claim 1 wherein the case comprises a handle formed thereon.

3. The toolbox apparatus according to claim 1 wherein the restraints are semi-cylindrical.

4. The toolbox apparatus according to claim 1 wherein the two restraints of the at least one second engagement unit are formed on two ends of the ridge, and the two restraints of the at least one first engagement unit are formed on two walls of the groove so that the ridge is located within the groove and the two restraints of the at least one first engagement unit are engaged with the two restraints of the at least one second engagement unit in the displaying position.

5. The toolbox apparatus according to claim 4 wherein the two restraints are semi-cylindrical.

6. The toolbox apparatus according to claim 1 wherein the at least one first engagement unit comprises two engagement units, and the at least one second engagement unit comprises two engagement units.

7. The toolbox apparatus according to claim 6 wherein the two restraints of the at least one first engagement unit are formed on two walls of the groove, and the two restraints of the at least one second engagement unit are each formed on two ends of the ridge so that the ridges are located within the groove and the two restraints of the at least one second engagement unit are engaged with the two restraints of the at least one first engagement unit in the displaying position.

8. The toolbox apparatus according to claim 1 wherein the case is only partially covered by the cover in the closed position.

9. The toolbox apparatus according to claim 1 wherein the cover face, the two lateral faces and the inclined face of the cover comprises a space defined therein for containing the tools.

10. The toolbox apparatus according to claim 1 wherein the case, the cover and the flexible strip are formed in one piece.

11. The toolbox apparatus according to claim 1 wherein the flexible strip is provided between the inclined face of the case and the inclined face of the cover.

12. The toolbox apparatus according to claim 1 wherein case defines a recess receiving the buckle.

13. The toolbox apparatus according to claim 1 wherein buckle defines a recess receiving the block.

14. The toolbox apparatus according to claim 1 wherein the cover comprises a flexible strip pivotally connecting the buckle thereto.

15. The toolbox apparatus according to claim 14 wherein the cover, the buckle and the flexible strip connecting the buckle to the cover are formed in one piece.

16. The toolbox apparatus according to claim 1 wherein the case comprises two blocks, and the cover comprises two buckles for engagement with the blocks.

* * * * *